US008062006B2

(12) United States Patent
Hummel et al.

(10) Patent No.: US 8,062,006 B2
(45) Date of Patent: Nov. 22, 2011

(54) NON-POSITIVE-DISPLACEMENT MACHINE COMPRISING A SPIRAL CHANNEL PROVIDED IN THE HOUSING MIDDLE PART

(75) Inventors: Karl-Ernst Hummel, Bietigheim-Bissingen (DE); Stephan Wild, Neuenbuerg (DE); Guenter Kroeger, Rahden (DE); Norbert Poppenborg, Bad Salzuflen (DE)

(73) Assignee: Mann + Hummel GmbH, Ludwigsburg (DE)

( * ) Notice: Subject to any disclaimer, the term of this patent is extended or adjusted under 35 U.S.C. 154(b) by 1169 days.

(21) Appl. No.: 10/578,187

(22) PCT Filed: Nov. 3, 2004

(86) PCT No.: PCT/EP2004/052774

§ 371 (c)(1),
(2), (4) Date: May 1, 2007

(87) PCT Pub. No.: WO2005/045201

PCT Pub. Date: May 19, 2005

(65) Prior Publication Data

US 2008/0034754 A1 Feb. 14, 2008

(30) Foreign Application Priority Data

Nov. 4, 2003 (DE) ..... 103 52 156

(51) Int. Cl.
*F04D 29/44* (2006.01)

(52) U.S. Cl. ..... 417/409; 417/406; 415/203; 415/204; 415/205; 60/605.2

(58) Field of Classification Search ..... 417/406–409; 415/203–206; 60/605.2
See application file for complete search history.

(56) References Cited

U.S. PATENT DOCUMENTS

| | | | | |
|---|---|---|---|---|
| 2,456,128 | A * | 12/1948 | Kessler | 415/206 |
| 3,844,676 | A | 10/1974 | Betteridge | |
| 4,009,668 | A | 3/1977 | King et al. | |
| 4,598,542 | A * | 7/1986 | Reynolds | 60/791 |
| 5,951,019 | A | 9/1999 | Slack et al. | |
| 6,145,846 | A | 11/2000 | Slack et al. | |
| 2005/0069427 | A1 * | 3/2005 | Roemuss et al. | 417/407 |

FOREIGN PATENT DOCUMENTS

| | | |
|---|---|---|
| EP | 1 394 366 A1 | 3/2004 |
| GB | 1 315 307 | 5/1973 |

OTHER PUBLICATIONS

International Search Report dated Mar. 8, 2005 (Six (6) pages).

* cited by examiner

*Primary Examiner* — Charles Freay
*Assistant Examiner* — Patrick Hamo

(57) ABSTRACT

A non-positive-displacement machine (10), particularly a turbomachine for producing a mass flow, having a central housing part (11) inside which a turbine shaft is mounted. A turbine housing is mounted on the central housing part (11) on a turbine side and a compressor housing is mounted on the central housing part (11) on a compressor side. The spiral channels (17, 18) required for the compressor side and for the turbine side can be arranged in a partial area inside the covers (15, 16) and at least in one partial area inside the central housing part (11). This permits the contours, which are required for the spiral channels (17, 18) and which are geometrically complex, to be constructed in the central housing part (11).

6 Claims, 4 Drawing Sheets

NON-POSITIVE-DISPLACEMENT MACHINE COMPRISING A SPIRAL CHANNEL PROVIDED IN THE HOUSING MIDDLE PART

BACKGROUND OF THE INVENTION

The invention relates to a fluid flow engine for producing a mass flow.

German Patent DE 10297203 describes a turbine housing for an exhaust gas turbocharger in which a turbine rotor driven by exhaust gases drives a compressor rotor. The compressor rotor is connected by a rigid shaft to the turbine rotor. The shaft which carries the compressor wheel and the turbine wheel is mounted in a central housing part which is sealed on the turbine end by a turbine housing and on the compressor end by a compressor housing. The exhaust gas flows tangentially into a spiral tapering contour of the turbine housing and is directed in a targeted manner at turbine blades of the turbine rotor. The turbine rotor is driven by these turbine blades. The exhaust gas flows further axially out of the turbine housing and to the turbine wheel. On the compressor end a mass flow is conveyed axially from the compressor rotor through the spiral channels to the tangential outflow. High demands are made of the spiral channels with regard to the geometry and surface. In the design shown here, the spiral channels are shaped in a turbine housing and a compressor housing. These two housings are flange connected to a central housing part at the sides. This embodiment can be manufactured only with a high technical manufacturing complexity because of the shaping involved.

SUMMARY OF THE INVENTION

The object of the present invention is to modify the design of the housing elements so that manufacturing of the spiral channels can be simplified.

This object is achieved by the features of the invention as described hereinafter.

Advantages of the Invention

The arrangement of the fluid flow engine according to the invention is based on the shifting of at least one part of the spiral geometry to a central housing part. This therefore forms at least part of a turbine housing or a compressor housing. The spiral geometry is sealed on the outside by a cover, with the cover forming the second part of the spiral geometry. Therefore, a cross section of the spiral channel is defined by the central housing part and the cover. A parting plane aligned perpendicular to a turbine shaft mounted in the central part of the housing is situated between the cover and the central part of the housing.

The fluid flow engine may be, for example, a turbo engine, e.g., an exhaust gas turbocharger or a secondary air charger for secondary air injection into a catalytic converter. However, it may also be used as a simple turbine for converting a mass flow into a rotor movement.

The inventive fluid flow engine advantageously makes it possible to shift a spiral contour into the central housing part, so the flow cross section of the spiral contour can be manufactured by the compression molding method without any undercuts. In addition, the narrower design of the cover results in reduced space requirements.

According to one embodiment of the invention, the cover on the area adjacent to the spiral contour is constructed to be flat. The spiral contour is formed exclusively in the central housing part. The contour corresponding to the turbine rotor and the axial inlet and discharge connections may be implemented without any changes.

This embodiment advantageously makes it possible to meet the high demands of the spiral geometry with respect to geometry and dimensional tolerance. Due to the simple geometry of the cover, it may also be made of plastics such as polyamide [nylon].

In one variant, the spiral geometries on the turbine side and the compressor side are arranged in the central housing part. Therefore, the length of the turbine shaft and thus the total housing length can be shortened. This further reduces the required design space.

An advantageous embodiment of the invention relates to the cross-sectional contour of the spiral channel, especially on the turbine side. The widening of the cross section of the spiral channel may be accomplished by axial and radial expansion. If the widening is accomplished by radial expansion, the axial depth of the spiral channel is reduced. Then the outside circumference of the spiral channel is increased. Since this circumference of the channel is smaller on the turbine side in comparison with the compressor side, enough space is available in the radial direction. Therefore, the entire housing may be designed to be shorter.

Another advantageous variant relates to the rotatory position of the spiral channels in relation to one another. Due to the reduced axial depth of the spiral channels, any rotatory position of the spiral channels relative to one another can be achieved. This is advantageous because frequently only a very limited installation space is available for the tangential incoming and/or outgoing flow connections. These may therefore be arranged at any angles to one another.

According to a special embodiment, at least one tangential connection is angled parallel to the turbine shaft. The tangential connection is preferably angled opposite the respective cover side. Therefore, a core of the connection may be designed to be without undercuts. The spiral contour and the core of the connection can therefore be manufactured by one mold part. This yields simple and economical manufacturing of the central housing part.

According to another embodiment, the tangential connections are arranged at variable angles to the turbine shaft. From the standpoint of the manufacturing technology, this variant can be implemented by side slides. The possible angle range is approximately 0 to 90°. It is therefore advantageously possible to design the oncoming flow angle of the tangential connections to the turbine shaft to be variable.

According to another embodiment, one or both tangential connections are integrally molded on the cover of the respective side. According to the angular design mentioned above, this may be accomplished from the standpoint of the manufacturing technology by a dual-shell mold or with a side slide. The further possibility of adapting the tangential connection to the geometry of the insulation space is advantageous here.

In another embodiment of this invention, the parting plane between the central housing part and the cover is arranged essentially centrally in the flow cross section of the spiral channels. In its axial position in relation to the turbine shaft, a spiral channel may be arranged essentially in the central part of the housing in a partial area and in another partial area it may be arranged essentially in the cover. It is thus advantageously possible to use both the cover and the central housing part for the arrangement of the spiral contours. Therefore, geometries that have been optimized in terms of the flow technology may be formed.

These and other features of preferred embodiments of the invention are derived not only from the claims but also from the description and the drawing, in which the individual features are implemented individually or several combined together in the form of subcombinations in embodying the invention and also in other fields and may represent advantageous and independently patentable embodiments for which patent protection is hereby claimed.

BRIEF DESCRIPTION OF THE DRAWINGS

Additional details of the invention are described on the basis of schematic diagrams of illustrative embodiments in the drawings, in which.

DETAILED DESCRIPTION OF PREFERRED EMBODIMENTS

Figure 1:
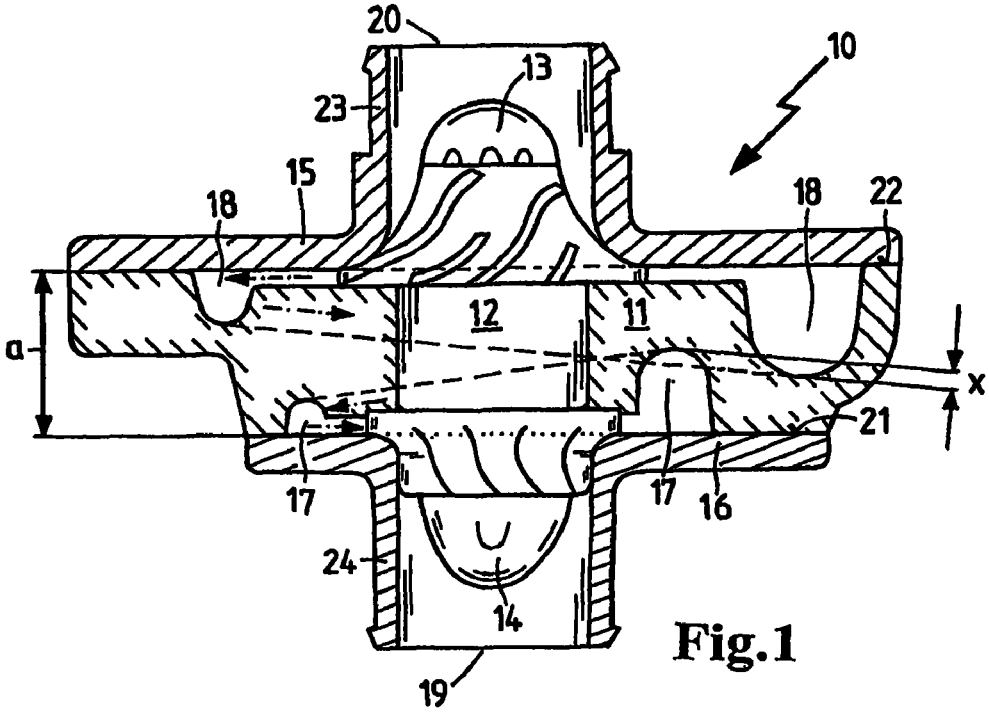
FIG. 1 shows a fluid flow engine in a full sectional view.

FIG. 1 shows an inventive fluid flow engine 10 in a full sectional view, with a turbine shaft 12 mounted in a central housing part 11. A compressor rotor 13 is rigidly mounted on the turbine shaft 12 and a turbine rotor 14 is rigidly mounted on the opposite side. The central housing part 11 is sealed on opposite ends by a turbine cover 16 and a compressor cover 15. These two covers 15, 16 are clamped on planar parting planes 21, 22 on the central housing part. Spiral channels 17, 18 are molded into both sides of the central housing part 11; these spiral channels are sealed by the covers 15, 16 on the planar parting planes 21, 22 on both cover ends. Between the parting planes 21, 22, the central housing part has a housing thickness a.

The spiral channels 17, 18 undergo a change in their circular cross-sectional area in the spiral contour, intersecting one another in the axial direction of the turbine shaft 12 with the dimension x in the area of the largest cross-sectional area. An outgoing flow connection 24 is arranged on the turbine cover 16 toward an outgoing flow side 19 on the turbine side and an axial oncoming flow connection 23 is arranged on the compressor cover 15 toward an oncoming flow side 20 on the compressor side.

Figure 2:
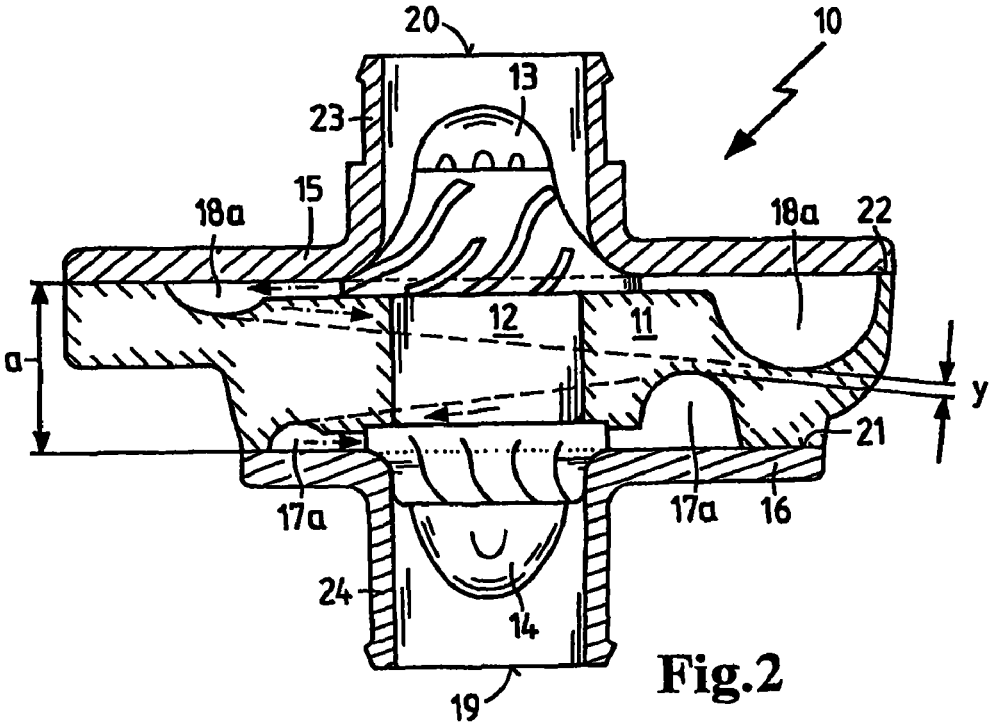
FIG. 2 shows another embodiment of the fluid flow engine in a full sectional view.

FIG. 2 shows another fluid flow engine 10 in a full sectional view. The components corresponding to those in FIG. 1 are labeled with the same reference numerals. The spiral channels 17*a*, 18*a* are designed with an oval shape in the central housing part in contrast with those in FIG. 1. In the area of the maximum flow cross sections of the spiral channels 17*a*, 18*a*, they are arranged with a mutual spacing y. This oval design of the spiral channels 17*a*, 18*a* need not extend over the entire length but instead may be provided only in the area of the largest cross-sectional area or only on one housing side. The housing thickness a can be reduced because of the oval design of the spiral channels 17*a*, 18*a*.

Figure 3A:
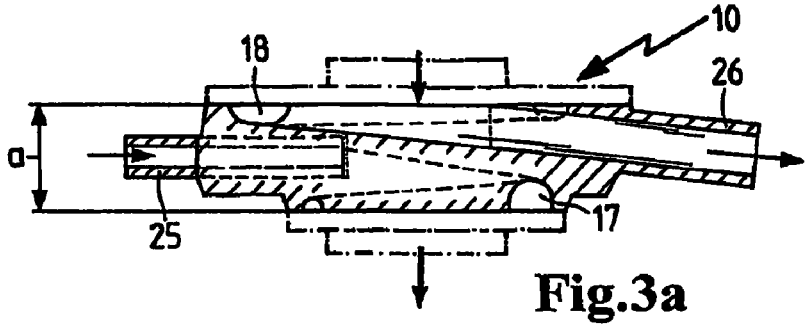
FIG. 3*a* shows a fluid flow engine in a full sectional view.

FIG. 3*a* shows another full sectional view through the fluid flow engine 10. Components corresponding to those in the previous figures are labeled with the same reference numerals. This shows an incoming flow connection 25 on the turbine side and an outgoing flow connection 26 on the compressor side. The spiral channels 17, 18 are partially depicted as dotted lines. The two connections 25, 26 are arranged tangentially to the spiral channels 17, 18 and correspond to them.

Figure 3B:
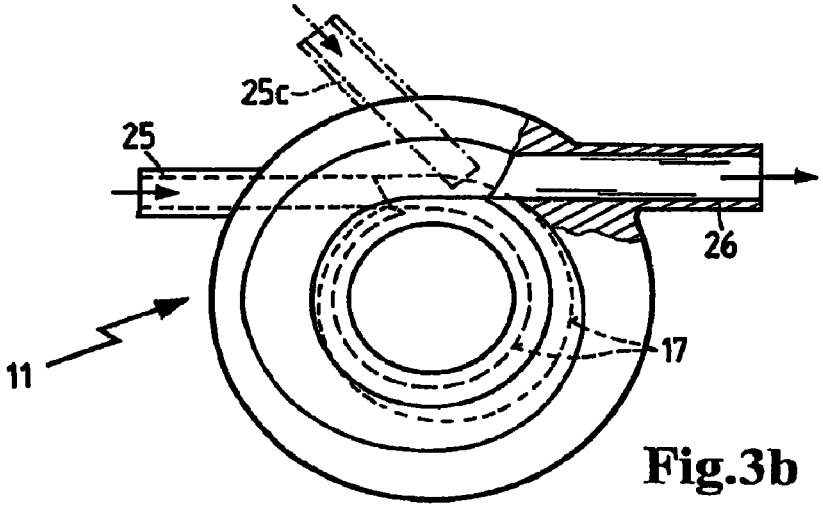
FIG. 3*b* shows a fluid flow engine according to FIG. 3*a* in a view from above.

FIG. 3*b* shows the central housing part 11 according to FIG. 3*a* in a view from above. The components corresponding to those in the previous figures are labeled with the same reference numerals. The shape of the spiral channel 17 on the turbine side is shown as a dotted line. In the area of the outgoing flow connection on the compressor side, the central housing part 11 is shown in a partial sectional view. The connections 25, 26 are arranged at an angle of 180° to one another.

With an angular arrangement according to the third connection 25*c* shown with dotted lines, the housing thickness a (FIG. 3*a*) must be increased to avoid overlapping of the spiral channels 17, 18.

Figure 3C:
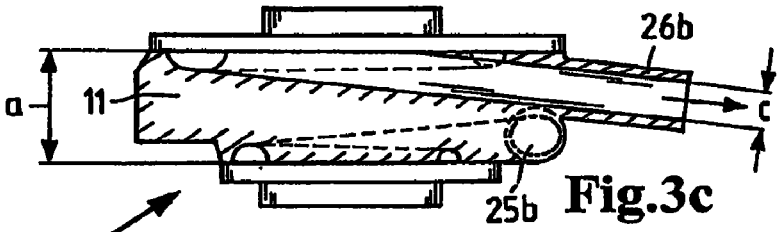
FIG. 3*c* shows a fluid flow engine in a full sectional view.
Figure 3D:
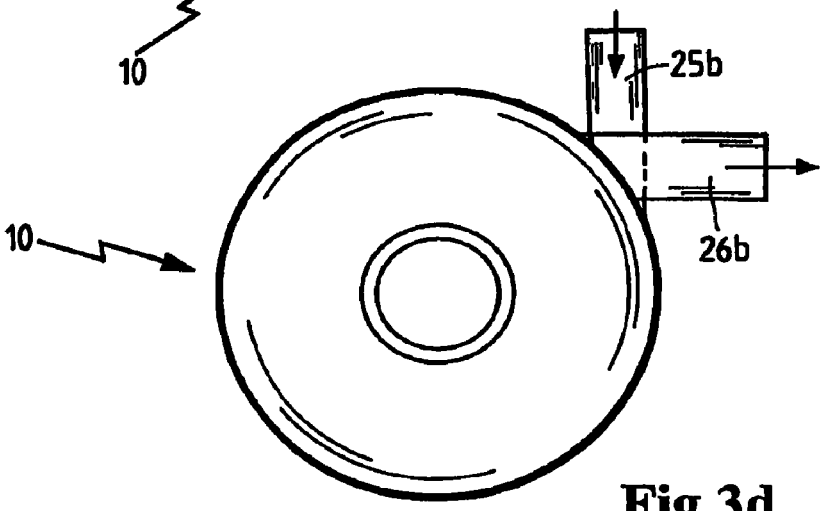
FIG. 3*d* shows a fluid flow engine according to FIG. 3*c* in a view from above.

FIGS. 3*c* and 3*d* show the connections 25, 26 of the central housing part 11 arranged at an angle of approximately 270° to one another where the two connections 25*b*, 26*b* intersect. This is the least favorable angular position because the housing thickness a is determined by the inside diameter c of the connections 25*b*, 26*b*. To minimize the housing thickness a in this angular position, the connections 25*b*, 26*b* are designed with an oval cross section in the intersecting area.

Figure 4:
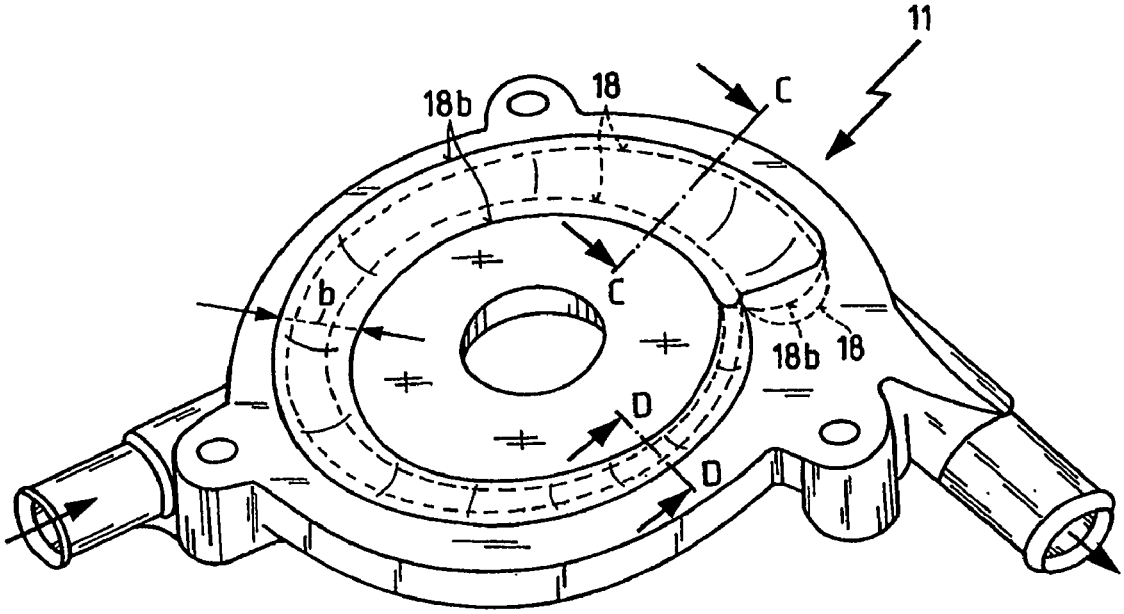
FIG. 4 shows a perspective view of a central housing part.

FIG. 4 shows the central housing part 11 in a perspective view on the compressor side. The circular shape of the spiral channel 18 on the compressor side is indicated with the dotted line, and oval spiral channel 18*b* is indicated with the solid line. The oval design results in a greater width b over the entire geometry of the spiral channel 18*b*. This may require a larger housing diameter. Owing to the smaller cross-sectional area of the spiral channel 17 on the turbine side (FIG. 3), this can also be designed to be only oval and thus broader. Therefore, a uniform housing diameter can be produced.

Figures 5A, 5B:
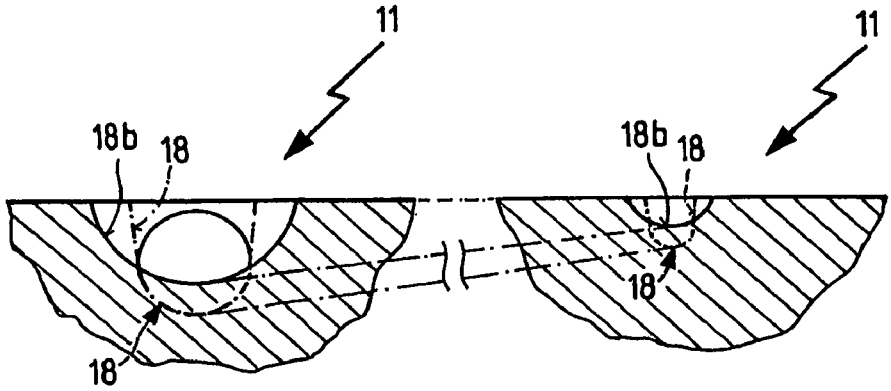
FIGS. 5*a* and 5*b* show a sectional diagram through the central housing part according to FIG. 4, FIGS. 6*a* and 6*b* show a schematic diagram of two variants of a fluid flow engine in a full sectional view.

FIGS. 5*a* and 5*b* each show a partial detail of the central housing part 11 according to FIG. 4, sections C-C and D-D. The width b of the oval spiral channel 18*b* is shown here in comparison with the width of the circular spiral channel 18, shown with dotted lines.

Figure 6A:
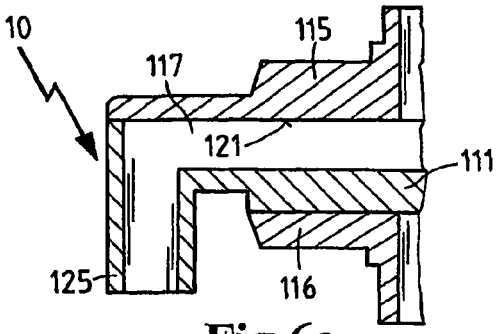
Figure 6B:
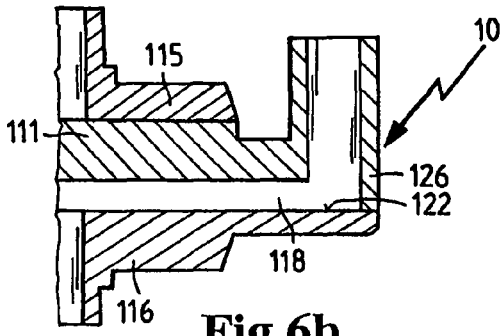

FIGS. 6*a* and 6*b* show the fluid flow engine schematically in a full sectional view in two variants. The two tangential connections 125, 126 are arranged at right angles to the parting planes 121, 122 on the housing part 111. The two outgoing flow connections 125, 126 are arranged opposite the side of their respective spiral channels 117, 118. The two covers 115, 116 seal the two spiral channels 117, 118 up to the area of the two connections 125, 126. Therefore, the spiral channels 117, 118 and the two connections 125, 126 are designed without any undercuts. This allows a simple manufacturing method using the compression molding technique.

Figure 7:
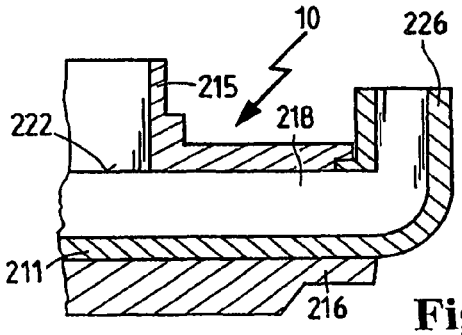
FIG. 7 shows a schematic detail of a fluid flow engine in a full sectional view.

FIG. 7 shows a schematic diagram of another variant of the fluid flow engine 10. The connection 226 here is arranged on the central housing part 211 and at a right angle to the parting plane 222 in the direction of the spiral channel 218 on the compressor side. The spiral 218 is sealed by the compressor cover 215. The undercut formed in the central housing part 211 can be produced, for example, by a mold with a drag slide in the compression molding method. The central housing part 211 is sealed on the turbine side by the turbine cover 216.

Figure 8:
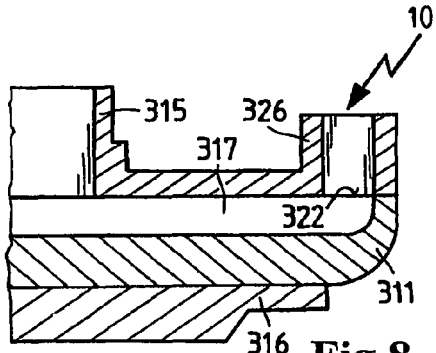
FIG. 8 shows another schematic detail of a fluid flow engine in a full sectional view.

FIG. 8 shows the fluid flow engine 10 in a schematic diagram. The connection 326 is arranged here on the cover 315 and corresponds to the spiral channel 317 on the parting plane 322. The simple housing 311 thus forms only the spiral contour 317 and can be manufactured without the connections 326, which are complex from the standpoint of the molding technology. On the turbine side the central housing part 311 is sealed by the turbine cover 316.

Figure 9:
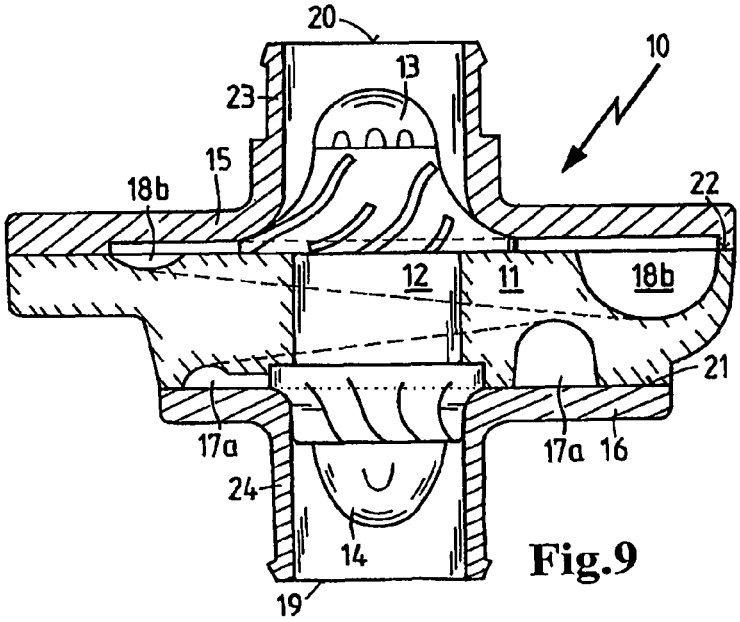
FIG. 9 shows another variant of a fluid flow engine in a full sectional view.

FIG. 9 shows a fluid flow engine 10 on which the parting plane 22 runs essentially centrally through the cross section of the spiral channel 18*b* on the compressor side. The spiral channel 18*b* extends parallel to the parting plane 22 in the compressor cover 15 and runs at an angle to the parting plane 22 in the central housing part 11. Therefore, in the illustrative embodiment shown here, the parting plane 22 is arranged centrally in the spiral channel 18*b* only in a partial area. The part having a simple geometry may be shaped by a simple planar groove in the compressor cover 15, for example, and the geometrically complex and precise shape may be located in the central housing part 11.

The two covers 15, 16 are preferably made of a plastic, whereby the central housing part 11 is preferably made of a metallic material.

The invention claimed is:

1. A fluid flow engine comprising a central housing part in which a turbine shaft is mounted, said housing part having a turbine side and a compressor side and being integrally molded as part of a turbine housing on the turbine side and as part of a compressor housing on the compressor side, wherein a turbine inlet connection is arranged tangentially to the turbine shaft on the central housing part on the turbine side, a turbine discharge connection is arranged axially on the turbine housing, a compressor outlet connection is arranged tangentially on the central housing part on the compressor side, and a compressor inlet connection is arranged axially on the compressor housing; and wherein a cover is provided on the compressor side or on the turbine side or on both, and the cover is constructed as part of the housing, and a spiral channel for the turbine side or for the compressor side or for both is provided in the central housing part, said spiral channel closed over by a respective one of said covers, wherein the spiral channel is formed exclusively in the central housing part, wherein said cover in an area adjacent to its respective spiral channel is constructed to be flat, wherein said turbine inlet connection or said compressor outlet connection or both join tangentially to said spiral channel, wherein the spiral channel has a maximum depth in the direction of the turbine shaft, wherein said spiral channel is oblong in cross section, said oblong spiral channel cross section wider in a radial direction compared to an axial depth of said cross section taken in an axial direction, directions taken relative to said turbine shaft, wherein for a given spiral channel cross section area, the axial depth of the oblong spiral channel into the housing part is reduced relative to a non-oblong spiral channel due to radial widening of said oblong spiral channel cross section, wherein the housing part can thereby be axially shortened by use of said oblong spiral channel.

2. A fluid flow engine as claimed in claim 1, wherein the spiral channels can be arranged in any desired rotational position in relation to one another around the housing circumference owing to their specific maximum depth, so that the tangential connections can be positioned at any angle relative to one another.

3. A fluid flow engine as claimed in claim 1, wherein at least one connection is angled and extends parallel to the turbine shaft.

4. A fluid flow engine as claimed in claim 3, wherein the tangential connections are arranged at a variable angle to the axis of the turbine shaft.

5. A fluid flow engine as claimed in claim 1, wherein the tangential connections are arranged on the cover of the turbine side.

6. A fluid flow engine as claimed in claim 1, wherein the tangential connections are arranged on the cover of the compressor side.

* * * * *